United States Patent [19]

Reiner

[11] 4,021,296

[45] May 3, 1977

[54] METHOD AND DEVICE FOR MANUFACTURING A CONTINUOUS MATERIAL WEB OF ELONGATED FIBROUS PARTICLES

[75] Inventor: Per Lennart Reiner, Gustavsberg, Sweden

[73] Assignee: A. Ahlstrom Osakeyhtio, Noormarkku, Finland

[22] Filed: Nov. 7, 1974

[21] Appl. No.: 521,861

[30] Foreign Application Priority Data

Nov. 23, 1973 Sweden ..... 7315882

[52] U.S. Cl. ..... 162/214; 162/216; 162/344; 162/347

[51] Int. Cl.[2] ..... D21F 1/06

[58] Field of Search ..... 162/212, 317, 214, 216, 162/344–345, 336

[56] References Cited

UNITED STATES PATENTS

| | | | |
|---|---|---|---|
| 3,296,066 | 1/1967 | Green et al. | 162/338 |
| 3,432,384 | 3/1969 | Dahl | 162/338 |
| 3,450,596 | 6/1969 | Green | 162/338 |
| 3,628,589 | 12/1971 | Means et al. | 162/336 |
| 3,846,230 | 11/1974 | Wahren et al. | 162/216 |
| 3,954,558 | 5/1976 | Egelhof | 162/336 |

FOREIGN PATENTS OR APPLICATIONS

| | | | |
|---|---|---|---|
| 267,307 | 12/1968 | Austria | |
| 1,538,087 | 7/1968 | France | |
| 1,320,749 | 2/1963 | France | 162/344 |
| 1,966,123 | 12/1971 | Germany | |
| 1,069,957 | 5/1967 | United Kingdom | |
| 1,179,847 | 2/1970 | United Kingdom | |
| 1,228,385 | 4/1971 | United Kingdom | |

OTHER PUBLICATIONS

Handbuch der Papier–Und Pappenfabrikation, 2. Auflage, Band II, p. 1801–(Germany).

*Primary Examiner*—Arthur D. Kellogg
*Attorney, Agent, or Firm*—Brooks Haidt Haffner & Delahunty

[57] ABSTRACT

A method and device for manufacturing a continuous material of elongated fibrous particles from a suspension of the fibrous articles with a concentration at least twice as high as thesediment concentration of the fibrous particles, in which the highly concentrated suspension is distributed and deflected in a chamber before the suspension is passed to a decay channel from which the suspension is deposited, is disclosed wherein the suspension is exposed in an intermediate forming channel between the chamber and the outlet channel to a plurality of changes of direction to change the direction which in turn contributes to the local variations of the fibre concentration in the suspension becoming more even.

21 Claims, 12 Drawing Figures

METHOD AND DEVICE FOR MANUFACTURING A CONTINUOUS MATERIAL WEB OF ELONGATED FIBROUS PARTICLES

BACKGROUND OF THE INVENTION

The invention relates to a method and a device of manufacturing a continuous material web of elongated fibrous particles from a suspension of the fibrous particles with a concentration at least twice as high as the sediment concentration of the fibrous particles, in which the highly concentrated suspension is distributed and deflected in a chamber before the suspension is passed to a decay channel from which the suspension is deposited.

The industrial paper manufacture has on the whole proceeded in the same way since the beginning of the nineteenth century. Only the machine sizes and the speed of the paper feeding process have increased. The fact that the deckles are bigger and the speeds of the machines have increased has called for all the more accuracy when manufacturing the machine parts. The costs have hence risen greatly and it might be mentioned, that the cost of investment for one modern newsprint machine, including equipment and buildings needed for it, amounts to nearly 35 million dollars. A considerable amount of the costs is needed for its wet end, i.e. the distribution system for the pulp material, inlet box and wire part.

As a principle, by formation of the sheet in a conventional way the following procedure takes place at the wet end of the machine: Fibre suspension, i.e. (more or less freely moving) cellulose fibres in water are roughly distributed over the breadth of the machine in a distribution system, for instance a cross distributor. The purpose of the inlet box is to make the fibres distribute themselves evenly also in micro scale with assistance of the irregular movements (turbulence) of the transporting medium. In order to remedy certain imperfections in the distribution system (for instance involving an oblique speed profile in the inlet box, which besides the fact that this directly results in an uneven surface weight profile across the paper web, it also indirectly results in an unstable flow with rough scale turbulence which appears on the wire section and disturbs the formation of the sheet) a certain number (2–5) perforated cylinders are placed in the way of the flow. The fibres in the suspension have a tendency to agglomerate because of mechanical-geometrical reasons. The perforated cylinders are furthermore supposed to generate turbulent areas of shearing force, meant to break up the fibre flocks occuring. Because of the fibres' tendency to flocculate, which is accentuated in an increased concentration, one cannot maintain a higher fibre concentration than approximately 0.5%, if an acceptable paper is to be had. (0.5 % means 5 g fibres per liter, kg, water).

From the inlet box the suspension, at best with the fibres evenly distributed, is portioned out through a narrow slot, as a horizontal jet, which is allowed to land on the wire (a more or less loose cloth of metal or plastic) which moves at the same speed as the jet. The thickness of the jet can vary from 10 up to or even exceed 50 mm. On the wire most part of the water must be removed. Before all fibres are fixed onto a fibre bed, the concentration must be increased from 0.5 to appr. 10%. With a jet height of 40 mm and an original fibre concentration of 0.5% this consequently means that 40 liters of water must be removed per $m^2$ of the wire and making use of those machine speeds produced presently by a high speed machine, this must take place within appr. 1 second. The dewatering takes place using various types of dewatering elements, which, depending on the circumstances, may either improve or deteriorate the formation of the sheet. In either case this process is extremely difficult to control.

As the jet lands on the wire the speed of the frame consequently corresponds to that of the jet. The formation of the sheet can therefore principally be compared to a sedimentation process, although an accelerated one, because of the dewatering elements. The sheet will be built up from the under side in such a manner, that the last remaining water has to be drained through practically the whole sheet. The input fibres have a certain size range, which always comprises some fine fractions in which the fibres or actually fibre fragments are small, smal, that they are washed out together with the water when the draining takes place. The retention, i.e. the part of the fibre material remaining on the wire, often amounts to just 50% or even less. Because of this mechanism one also achieves a sort of two-sided sheet, as here is a certain depletion of material at the bottom of the sheet, while at the same time the contents of such material is higher towards the top face of the sheet. This two-sidedness of the paper will be even more pronounced. when some filling substance is added to the beating material, for instance clay in certain qualities of printing paper. This is also characteristic for papers containing wood pulp, i.e. newsprint. The fibre material of such paper contains a high percentage of fine fractions, which results in different printing qualities for the two sides of the sheet. The sheet forming mechanism related above lends the sheet a special two-dimensional structure, when compared to sedimentation. Owing to the geometrical shape (length 1–5 mm, diameter 30–50 $\mu$ um) all fibres settle in such a way, that they end up in a position parallel to the sheet. The sheet consequently consists of a number of layers parallel to one another, which fact naturally will affect the various qualities of the paper, such as strength, stiffness, etc.

Above related in a simplified way explains the sheet forming process taking place in today's paper manufacture. Other forms, of course, also exist, but they do not to any greater extent differ from the procedure discribed here. The cellulose fibres are in one way or another delivered onto a wire and after the dewatering process has been carried out long enough so that the strength of the sheet formed permits that it be lifted off the wire, it is transported to the press section, where still more water is removed. The final dryness is achieved after the paper has been dried against a number of heated drying cylinders.

In accordance with the U.S. Pat No. 3,846,230 furthermore another manner and an apparatus for forming a continuous pulp path, starting out from a highconcentrated suspension of slim particles, is known. In this case the high concentrated suspension is fed from a cross distributor conforming to accepted standards, through a row of channels connected parallel to one another, the outlet of which taper down to a row of slots, where the pulp is fed on by high speed to a chamber, common for all the channels, where the accelerated flow is lead anew through a throttling for acceleration of the stream, before this is again deflected and fed into a decay channel, in order to decay the turbulence of the flow, before the three dimensional network structure consolidated therein, is deposited. According to this well known technique, a high enough flow of pressure ΔP has to be achieved, over a small enough volume, V, in order to get the power per unit volume needed $\epsilon$, whereas the relationship $= \epsilon = \Delta PQ/V$, where $Q$ means the volume flow. The sediment concentration is hereby defined through the formula $C_s = 108\ \pi, (l/l)^2$, when $C_s$ = sediment concentration, $r$ = fibre radius and $l$ = length of fibre.

The object of the present invention is to provide an improvement to the method through which a continuous material path of fibrous particles, outgoing from said suspension of fibrous particles with a concentration corresponding to at least twice the sediment concentration of the fibrous particles can be formed; as well as an improved apparatus by help of which this method can be carried out.

SUMMARY OF THE INVENTION

According to the invention the suspension emerging from the chamber is passed to an intermediate forming chamber between the chamber and the outlet channel in order to expose the suspension to a plurality of changes of direction to change the direction of orientation amongst the fibres themselves.

This invention calls for the construction of the decay channel as a forming channel before the outlet end of the forming device. Through the production of a fine scale turbulence by way of, for example, a series of alternating area increases or decreases or a number of bends or a combination of both, a degradation of the fibre flocks occuring in the suspension is attained, and furthermore the deformation of the network structure can take place through shearing, for instance with a number of bends in the direction of the flow, which makes the fibres freer to move relatively to one another, which enables them to take such positions that the uniformity of the structure can be still further improved.

Corrugation parallel to the flow on the upper and lower walls of the forming channel will help the fibres in finding the correct direction, and a decreasing height of the channel wall will, in case the channel is made short, produce an upward direction of the fibres in the direction of the flow.

DESCRIPTION OF THE EMBODIMENTS

Figure 1:
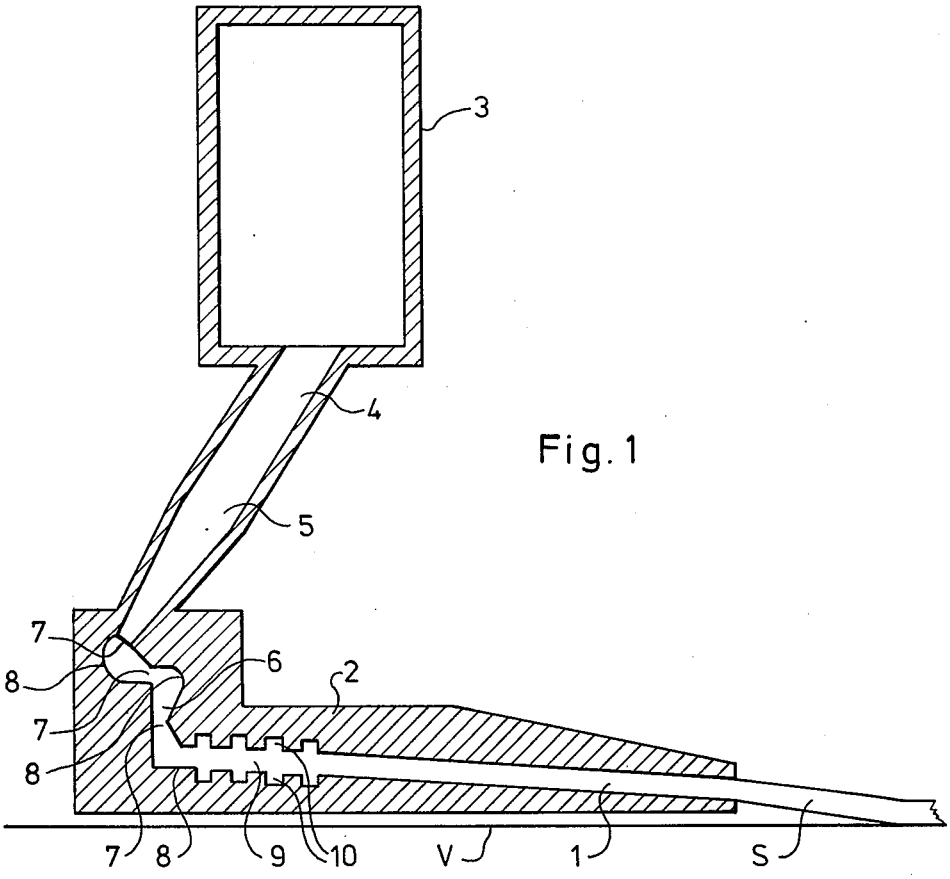
FIG. 1 schematically shows a cross section through a forming device with a type of forming channel in accordance with the invention, where one part has alternatively increasng and decreasing height of the channel.

In the FIGS. 1 designates an outlet channel, from which the network structure in the form of a jet S is forwarded onto for instance a wire (Fig. 1). Number 2 designates a forming part. The forming device, shown in FIG. 1, is mainly composed of a cross distributor 3, from which the suspension is distributed to a number of channels, connected in parallel, 4, which in the area 5 gradually flatten down. The deflection chamber is generally marked 6 and composes deflection areas and throttlings 8 respectively 7.

FIG. 1 shows in cross section a way of constructing the forming channel in accordance with the invention. The part marked 9 is all along equipped with a number of slots, *lo*, placed opposite each other as shown in the vertical section. This results in a channel height and consequently a channel area which alternatively increases and decreases. These cuts are, as easily can be understood, placed as parallel grooves across the direction of the suspension's flow in the channel.

Figure 2:
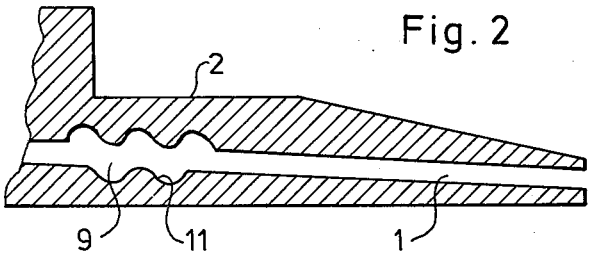
FIG. 2 shows a cross section through a forming channel with bends facing each other and in the main fixed height of the channel.

In FIG. 2 the part 9 has the shape of a continuous sinusoidal bend 11, with mainly fixed height of the channel.

Figure 3:
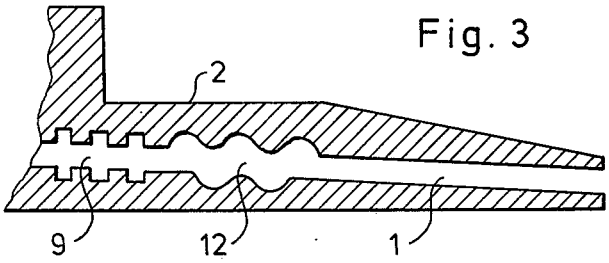
FIG. 3 shows across section through a forming channel with varying channel height and a stretch with bends used in combination.

In FIG. 3 the part 9 is shown shaped like a combination of channel 10 respectively 11, according to FIG. 1 and FIG. 2, whereby the sinusoidal stretch 11 follows upon the alternately increasing and decreasing cross cut channel area 10.

Figure 4:
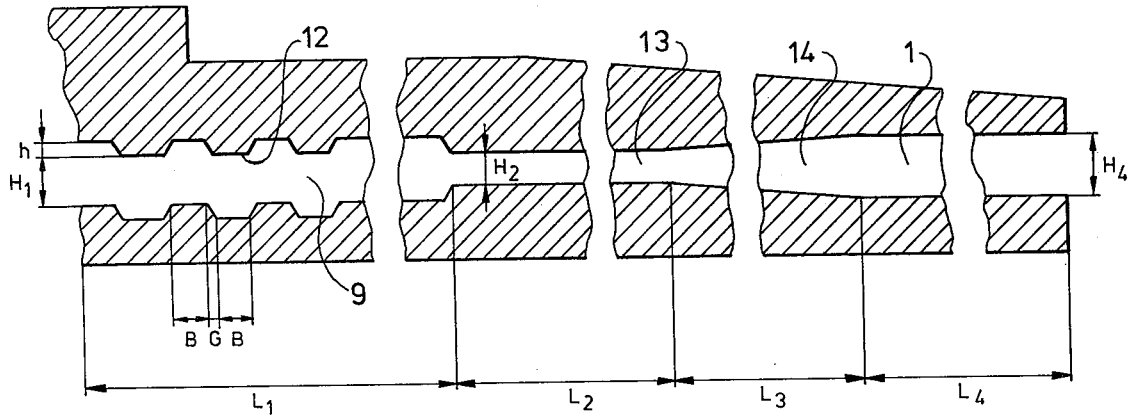
FIG. 4 shows a cross section through a forming channel with a stretch made up of varying channel height and bends as well, and in addition to that one part with increasing height of the channel.

In FIG. 4 furthermore part 9 is shown as a combination 12 having varying channel height and bends along same first stretch, which is followed by a stretch 13 with less channel height than named first stretch, before a channel height gradually increasing 14, which transforms into the outlet channel 1.

The varying channel heights and bends shown in FIGS. 1–4 are supposed to produce turbulence for the disintegration of possibly remaining fibre flocks.

By way of decreasing the channel height in part 9 as shown in FIG. 4 and following figures and/or after that make still another arrangement with alternating or bending channel cross sections or a combination thereof, a continued decrease of the scale of the occuring fibre flocks will follow.

Figure 5:
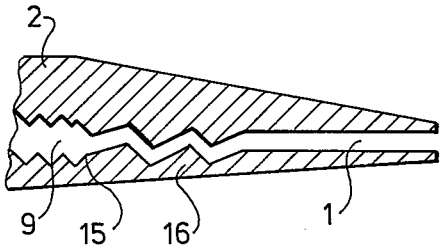
FIG. 5 shows in action a forming channel in accordance with any one of the FIGS. 1–4, immediately followed be a prompt contraction, a stretch with a number of bends.

In case this decrease of the channel height and the area reduction due to it is performed quickly, as shown in FIGS. 4 and 5, an average alignment of the fibres in the direction of the flow is likely to follow. By this means the sheet produced can be granted anisotropic qualities. If, on the other hand, the area reduction of the channel takes place slowly, which is the fact in the forming channel according to FIG. 6, the alignment of the fibres is avoided.

Thus FIG. 5 shows quick throttling, 15, following a stretch with increasing and decreasing channel height, after which follows a stretch 16 with a channel height smaller than the previous and holding a number of bends. On this distance 16 follows outlet channel 1.

Figure 6:
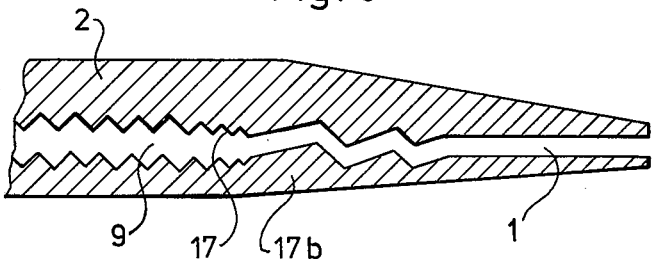
FIG. 6 shows in section a forming channel according to FIGS. 1–4, immediately followed by slow contraction with varying channel form and a stretch with a number of bends.

FIG. 6 shows in cross cut a channel 9 with alternatively increasing and decreasing channel cross sections which, contrary to the channel in FIG. 5, transforms into a stretch 17 with slowly decreasing channel height with a number of bends and an outlet part 1.

Parts 16 and 17 in FIG. 5 and 6 are equipped with bends meant to expose the passing network structure to shearing, which will lessen the force of the individual fibres and thus participate in making the fibre distribution more even. Contrary to the bends shown in FIG. 2 and 3 the bends in FIG. 5 and 6 must not bring about so high turbulence intensities that the network structures is altogether broken.

The jet S, which is deposited, must as a rule, in order to produce the wanted surface weight by constant fibre concentration. thicker than the corresponding height of the slimmest channel part. This can according to the invention very well be done through arranging one part with slowly increasing channel height before the outlet channel 1, which has a fixed height. The thinnest part of the channel must be as thin as possible, to impart small proportions to the fibre flocks. Restrictions are among others the purity of the pulp, permitted fall of pressure and the accuracy of manufacture. Minimum channel height is of a size on the order of 1 mm.

Figure 7:
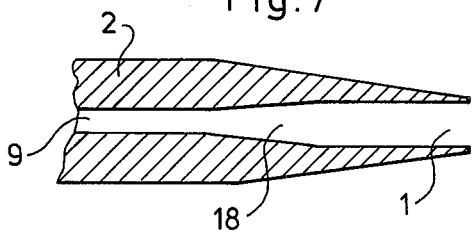
FIG. 7 shows in cross section an outlet part which is preceded by a part with increasing height.
Figure 8:
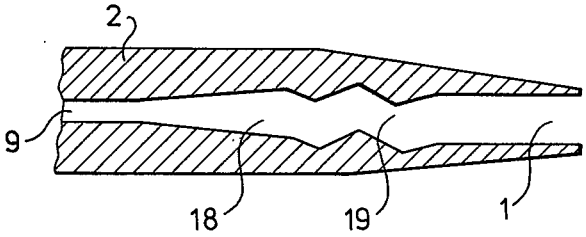
FIG. 8 shows in cross section a channel in accordance with FIG. 7, but it has one part with a number of bends immediately preceding the outlet channel.

FIGS. 7 and 8 thus each one show in cross section a channel, the part 18 of which before outlet channel 1 has a slowly increasing height. According to FIG. 7 this part 18 is immediately followed by the outlet channel 1 and in accordance with FIG. 8 is between part 18 and outlet channel 1 arranged still one stretch 19, comprising a number of bends producing a shearing effect.

Figure 9:
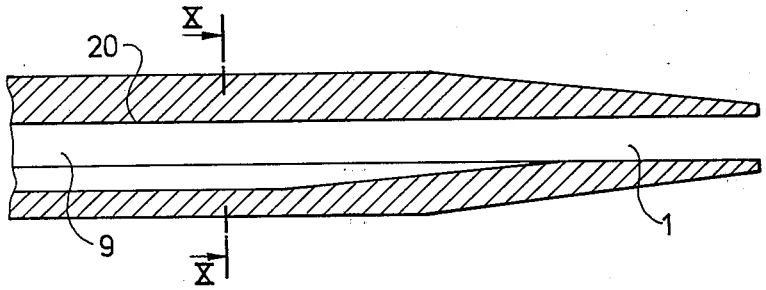
FIG. 9 shows a cross section through a forming channel with longitudinal grooves in the direction of the flow and FIG. 10 shows a cross section along the line X—X in FIG. 9.
Figure 10:
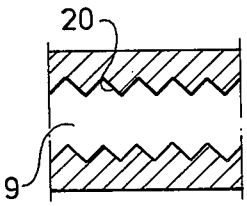
Figure 11:
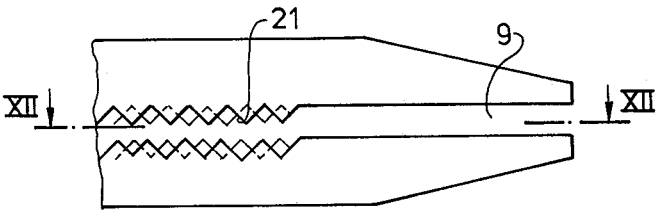
FIG. 11 shows a section of still another embodiment. The outlet channel 9 of this embodiment is designed with waves or opposite bows at two cross wise directions in the lower as well as the upper surface of the channel. In this manner there is obtained a profiled channel form in a section in an arbitrary direction to the direction of flow of the suspension.
Figure 12:
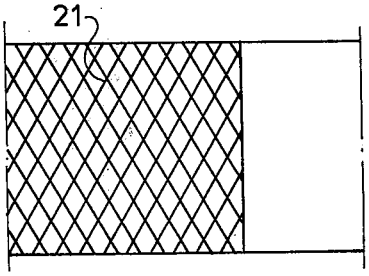
FIG. 12 is a section along line XII — XII in FIG. 11.

FIG. 9 shows a cross section of another embodiment of the invention presented. The outlet channel 9 is according to this variation provided with waves or oppositely placed bends 20, before it is transformed into decay channel 1. These waves or opposite bends 20 are, contrary to the construction shown in previous examples, arranged to extend in the direction of the suspension's flow and their main purpose is to help the fibres find their way in the direction of the flow. As shown in FIG. 10 the breadth of the outlet channel has a zig-zag construction, whereby the channel height across the channel must, however, be kept constant so that an even flow can reach the outlet channel.

Quite naturally it is possible within the limits of this invention to shape the outlet channel as a combination of the designs according to FIGS. 1–8 and using FIGS. 9, 10, 11 and 12 for the form of execution.

The channel designs shown and explained are, as already stated, only examples of the invention and also they can be varied in a way, which is best suitable for the purpose and the constructioning possibilities.

As has been proved by above description, this invention aims at, outgoing from the premises given, bringing about a clearly defined turbulence in the pulp suspension before it flows on into the outlet channel to be deposited on for instance the endless wire.

The invention will also be described in connection with an executed example when manufacturing fluting starting from a fibre suspension with a consistency of 3%, giving a surface weight of 120 g/m$^2$. The forming device used is the one shown in FIG. 4. The actual measures for the various sections are in the figure marked with letters, which in the illustrated example have following values:

Stretch 9 - length $L_1 = 45$ mm and height $H_1 = 3$ mm,
Stretch 13 - length $L_2 = 30$ mm and height $H_2 = 2$ mm and
Stretch 14 - length $L_3 = 85$ mm.
Decay channel - length $L_4 = 40$ mm and height $H_4 = 4$ mm.

The height of stretch 14 changes from $H_2$ to $H_4$, i.e. slowly increases from 2 to 4 mm.

In the example described other dimensions are h = 1 mm, B = 2 mm and G = 1 mm.

These dimensions prove that the average speed in the "corrugated" section approximately corresponds to the outlet speed = actual machine speed. The speed in the narrowest section is twice as high.

I claim:

1. An improved method of manufacturing a continuous material web of elongated fibrous particles from a suspension of the fibrous particles with a concentration at least twice as high as the sediment concentration of the fibrous particles, in which the highly concentrated suspension is distributed and deflected in a chamber before the suspension is padded to a decay channel from which the suspension is deposited, the improvement comprising passing the highly concentrated suspension through an intermediate forming channel having a substantially uniform channel height between the chamber and the outlet channel and causing said suspension to undergo a number of substantially equal angular changes of direction as the suspension passes a series of bends in the intermediate channel to change the direction of orientation amongst the fibres themselves which in turn causes local variations of the fibre concentration in the suspension to decrease.

2. The method in accordance with claim 1, in which the changes of direction are caused by passage of the suspension on a sinusoidally sinuous path through said intermediate channel.

3. The method in accordance with claim 1, comprising repeated deflections of the suspension, alternating in successively opposite directions.

4. The method according to claim 1, comprising changes of direction achieved by repeated deflections of the suspension, upwards and downwards in succession.

5. The method according to claim 1, in which the suspension is passed to a diverging outlet after the end of said intermediate channel.

6. The method according to claim 5, in which the suspension is passed through a constriction between said intermediate channel and said outlet.

7. The method according to claim 1, in which the suspension is exposed to a strong expansion after said changes of direction.

8. The method according to claim 7, in which the strong expansion takes place slowly.

9. An improved device for manufacturing a continuous material web of elongated fibrous particles outgoing from a suspension of the fibrous particles which has concentration equal to at least twice the sediment concentration of the fibrous particles, and of the type having a chamber, in which the high concentration suspension is distributed and deflected and a decay channel wherefrom the suspension is deposited, the improvement comprising an intermediate forming channel between the chamber and the outlet channel and having generally uniformly spaced upper and lower walls which walls have mutually opposed substantially similar means for deflecting the suspension upwards and downwards through substantially equal angular changes of direction.

10. Device according to claim 9, wherein the deflecting means comprises opposed cuts and bars with angular profiles on the channel walls.

11. Device according to claim 9, wherein the deflecting means comprises rounded opposed cuts and bars on the channel walls.

12. Device according to claim 9, wherein the deflecting means comprises bars on one wall placed opposite cuts on the other wall of the channel.

13. Device according to claim 9, wherein bars and cuts formed in the channel walls stretch out in the direction of the flow of the suspension.

14. Device according to claim 9, wherein the deflecting means comprises bars on one wall placed opposite cuts on the other wall of the channel.

15. Device according to claim 9, wherein bars and cuts formed in the channel walls stretch out in the direction of the flow of the suspension.

16. Device of claim 9, wherein bars and cuts formed in the channel walls are aligned in two directions crossing each other.

17. Device of claim 9, wherein bars on one wall of the channel are placed opposite cuts in the other wall of the channel in such a way that the channel's height is substantially constant in each channel cross section.

18. Device according to claim 9, wherein the intermediate forming channel has one stretch with a channel height which differs from the average height present in the rest of the channel.

UNITED STATES PATENT AND TRADEMARK OFFICE

CERTIFICATE OF CORRECTION

PATENT NO. : 4,021,296

DATED : May 3, 1977

INVENTOR(S) : Per Lennart Reiner

It is certified that error appears in the above-identified patent and that said Letters Patent are hereby corrected as shown below:

Col. 2, Line 19

"are small, smal, that they" should read -- are so small, that they --.

Col. 3, Line 2

"a high enough flow of" should be --a high enough fall of--

Line 52

"increasng" should be --increasing--

Line 63

"in action" should be --in section--

Col. 6, Line 30, "suspension is padded" should be -- suspension is passed --.

Signed and Sealed this

Sixth Day of December 197

[SEAL]

Attest:

RUTH C. MASON
Attesting Officer

LUTRELLE F. PARKER
Acting Commissioner of Patents and Trademarl